US006506024B1

(12) United States Patent
Thompson et al.

(10) Patent No.: US 6,506,024 B1
(45) Date of Patent: Jan. 14, 2003

(54) INDUCER WHEEL AND METHOD OF FORMING THE SAME

(75) Inventors: Kevin D. Thompson, Indianapolis, IN (US); Christopher M. Clay, Indianapolis, IN (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/925,383

(22) Filed: Aug. 9, 2001

(51) Int. Cl.[7] ..... F04D 29/18
(52) U.S. Cl. ..... 416/244 R; 416/186 R
(58) Field of Search ..... 416/186 R, 213 R, 416/213 A, 244 R, 244 A, 204 R

(56) References Cited

U.S. PATENT DOCUMENTS 3,893,817 A * 7/1975 Hackbarth et al. ... 29/156.8 CF
4,340,560 A * 7/1982 Migeon ..... 264/249

* cited by examiner

*Primary Examiner*—Edward K. Look
*Assistant Examiner*—J M McAleenan
(74) *Attorney, Agent, or Firm*—Wall Marjama & Bilinski LLP

(57) ABSTRACT

An inducer wheel or impeller in which the hub may be formed by machining, rather than by molding, and which possesses a generally cylindrical cavity having a flattened section without a tapered inner diameter. Consequently, the hub may be mounted on a rotatable shaft having a corresponding flattened portion of a rotatable shaft with relatively small tolerance between the periphery of the shaft and the interior cavity wall of the hub uniformly along the shaft length. A plastic rotor may be molded onto the hub such that the plastic abuttingly contacts the flattened region of the rotatable shaft and surrounds and covers a relatively large peripheral area of the hub. A method of making such an inducer wheel is disclosed, and the inducer wheel made by such a method is also disclosed.

42 Claims, 5 Drawing Sheets

INDUCER WHEEL AND METHOD OF FORMING THE SAME

BACKGROUND OF THE INVENTION

Inducer wheels or impellers have been used with condensing furnaces to draw air and gas through a heat exchanger. In a broader sense, inducer wheels or impellers create a pressure differential in a fluid in order to move the fluid from one location to another.

Inducer wheels usually include a generally disk shaped rotor and a centrally disposed hub by which the inducer wheel is mounted to a rotatable shaft. The rotor section includes a plurality of blades generally radially extending from the hub which function like the blades of a fan.

In some inducer wheels, the rotor portion is fashioned substantially of plastic, and the hub is fashioned of metal. The rotor may be secured to the hub by placing the hub in a mold for forming the rotor from liquid plastic and allowing the plastic to flow around the hub and then-harden. The periphery of the hub usually includes a series of ridges or depressions that form a drive gear whereby rotation of the shaft causes concurrent rotation of the hub, which in turn causes concurrent rotation of the rotor by contact of the rotor with the series of ridges or depressions in the drive gear of the hub.

Typically, the rotatable shaft upon which the inducer wheel is mounted is generally cylindrical in shape, but is provided with a flattened peripheral region extending longitudinally along the shaft. The hub is also provided with a substantially cylindrical cavity in which the shaft is adapted to extend, with very little tolerance between the wall of the cavity and the periphery of the shaft. The hub cavity is also provided with a flattened section that conforms with the flattened section of the shaft so that the hub does not slip relative to the shaft when the shaft is rotated. A set screw may extend radially through the hub to selectively clamp the hub to the shaft at a selected location along the shaft.

Two problems have arisen in connection with the foregoing types of inducer wheel assemblies. First, the hub with a flattened portion of the cavity wall must be made of powdered metal that solidifies when molded. A probe must be disposed in the mold, with the powdered metal being solidified around the probe, whereafter the probe is withdrawn. However, in order for the probe to be withdrawn, the probe necessarily possesses a draft (i.e., a tapered inner diameter). As such, the tolerance between the actual rotatable shaft periphery and the interior walls of the cavity increases along the shaft length, thereby causing a relatively loose fit between the hub and the shaft and inducing wobble or vibration in the inducer wheel when the shaft is rotated. Such vibrations cause the plastic forming the rotor in the vicinity of the drive gear to become cracked and eventually break away, requiring replacement. Second, in the powder metal hub designs, the amount of plastic in the rotor that intimately contacts the hub in the region of the drive gear has been relatively insufficient, which likewise has resulted in cracking and breakage of the plastic in the region of the drive gear.

SUMMARY OF THE INVENTION

The present invention relates to an inducer wheel or impeller in which the hub may be formed by machining, rather than by molding, and which possesses a generally cylindrical cavity having a flattened section without a tapered inner diameter. Consequently, the hub may be mounted on a rotatable shaft having a corresponding flattened portion with relatively small tolerance between the periphery of the shaft and the cavity wall of the hub uniformly along the shaft length. A plastic rotor may be molded onto the hub such that the plastic abuttingly contacts the flattened region of the rotatable shaft and surrounds and covers a relatively large peripheral area of the hub. A method of making such an inducer wheel is disclosed, and the inducer wheel made by such a method is also disclosed.

BRIEF DESCRIPTION OF THE DRAWINGS

The present invention will be described with reference to the accompanying drawings, wherein.

DESCRIPTION OF A PREFERRED EMBODIMENT

The following description of a preferred embodiment is for the purpose of explanation, and not limitation. Some specific details are set forth in order to provide a better understanding of a preferred embodiment of the present invention, however, in other instances, description of other elements, features, and techniques are omitted so as not to encumber or confuse the reader with unnecessary detail. It will be apparent to one skilled in the art that the present invention may be practiced in other embodiments that depart from the following description and that differences may exist from the embodiment specifically described without departing from the spirit and scope of the present invention. The following detailed description is therefore not to be taken in a limiting sense.

Figure 1:
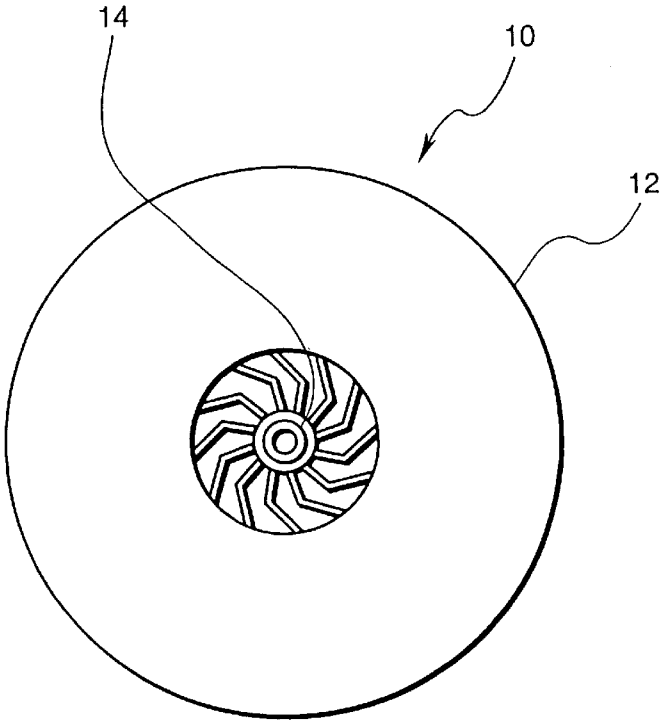
FIG. 1 is a plan view of an inducer wheel in accordance with one embodiment of the present invention.
Figure 2:
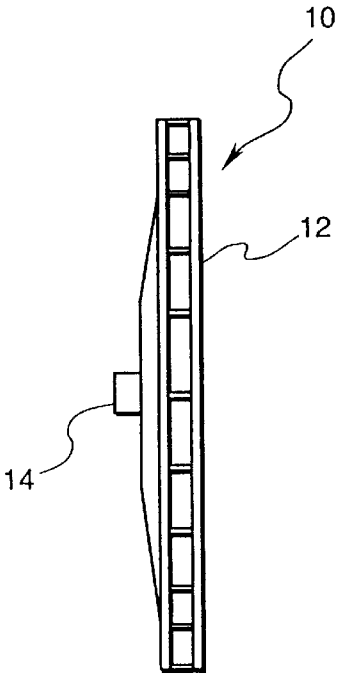
FIG. 2 is a side view of the inducer wheel shown in FIG. 1.
Figure 3:
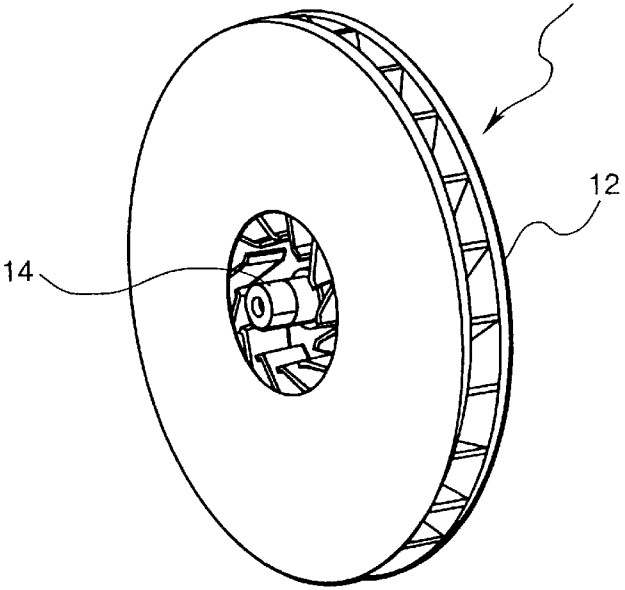
FIG. 3 is a perspective view of the inducer wheel shown in FIGS. 1 and 2.

FIGS. 1–3 disclose an inducer wheel 10 in accordance with one embodiment of the present invention. The inducer wheel 10 is generally disk shaped and includes a rotor 12 as well as a hub 14 disposed centrally within the rotor 12. The rotor 12 includes a series of blades generally radially extending from the hub 14, such that rotation of the rotor 12 causes any fluid (such as an air and gas mixture) in the vicinity of the blades to be drawn from one location and forced toward another location. That is, rotation of the rotor 12 creates a fluid flow.

The hub 14 is adapted to be mounted on a rotatable shaft (not shown) having a generally cylindrical periphery with a flattened section extending longitudinally therealong. The rotatable shaft may be rotated by an electric or other type of motor.

Figure 10B:
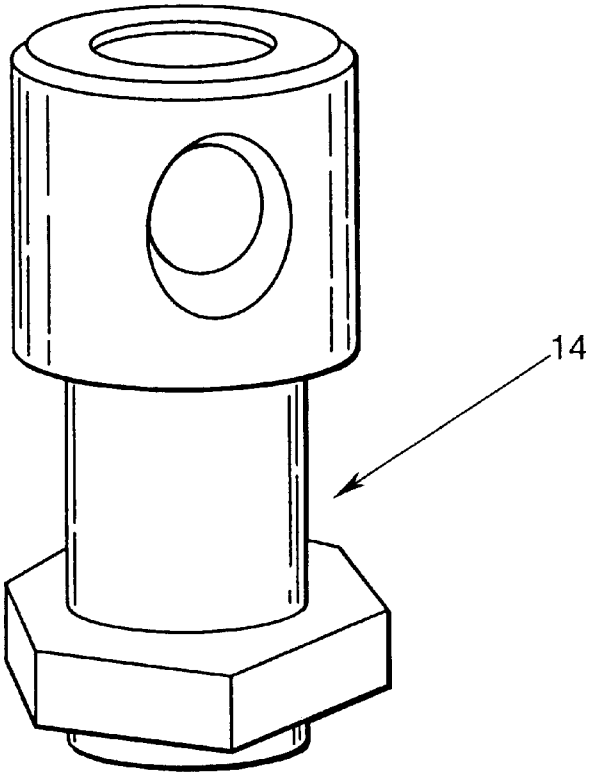
FIGS. 10A and 10B are perspective views of a prior art hub and the hub shown in FIGS. 4–8, respectively.
Figure 10A:
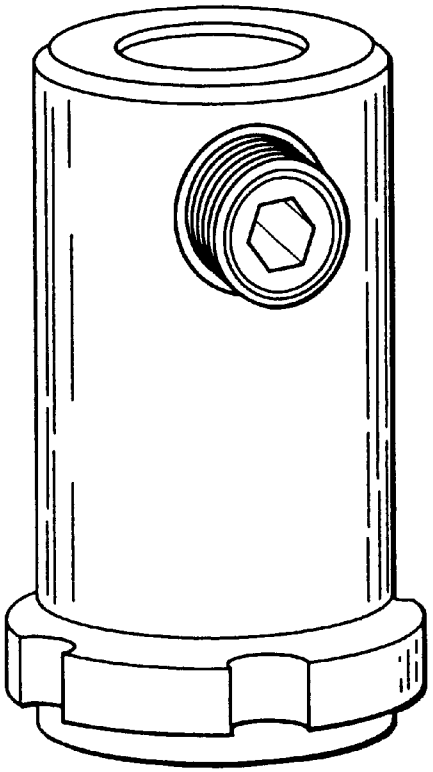
Fig. 10A (Prior Art)
Figure 11B:
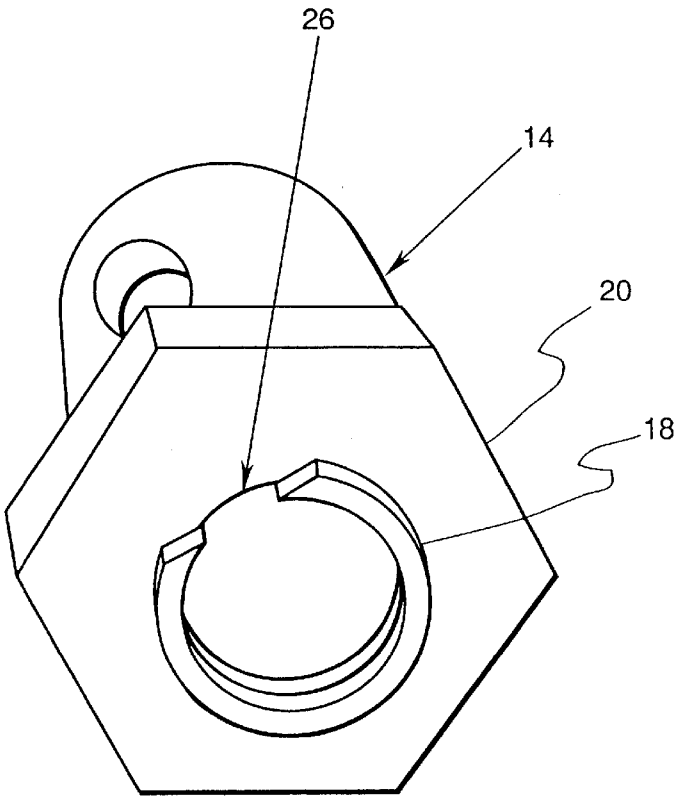
FIGS. 11A and 11B are different perspective views of the prior art hub and the hub shown in FIGS. 10A and 10B.
Figure 11A:
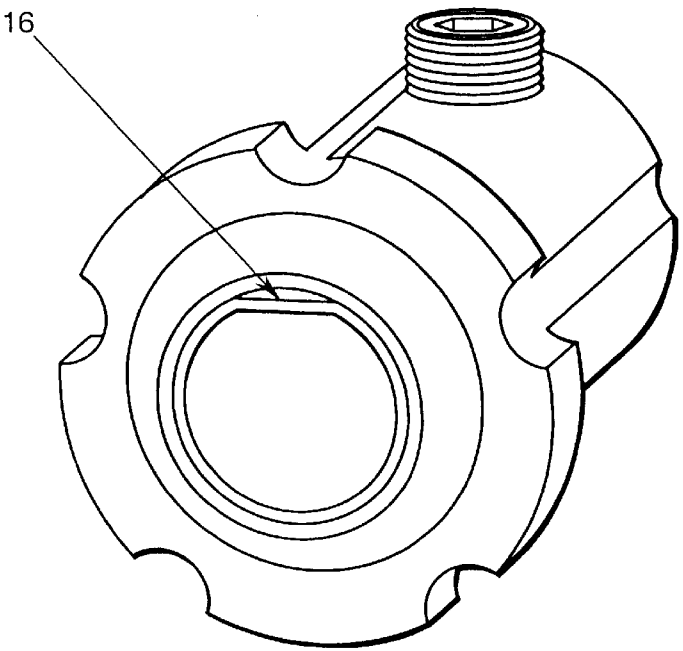
Fig. 11A (Prior Art)
Figure 12B:
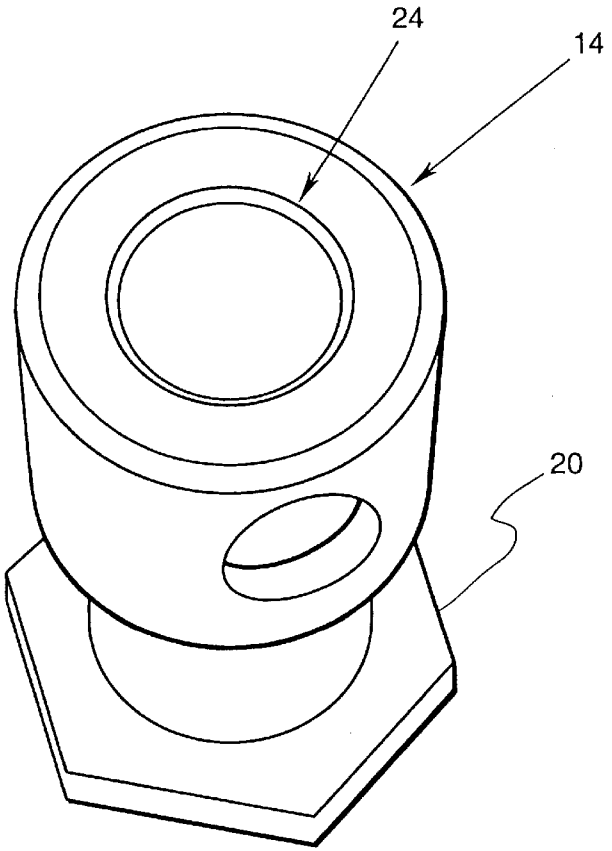
FIGS. 12A and 12B are yet another perspective view of the prior art hub and the hub shown in FIGS. 10A and 10B.
Figure 12A:
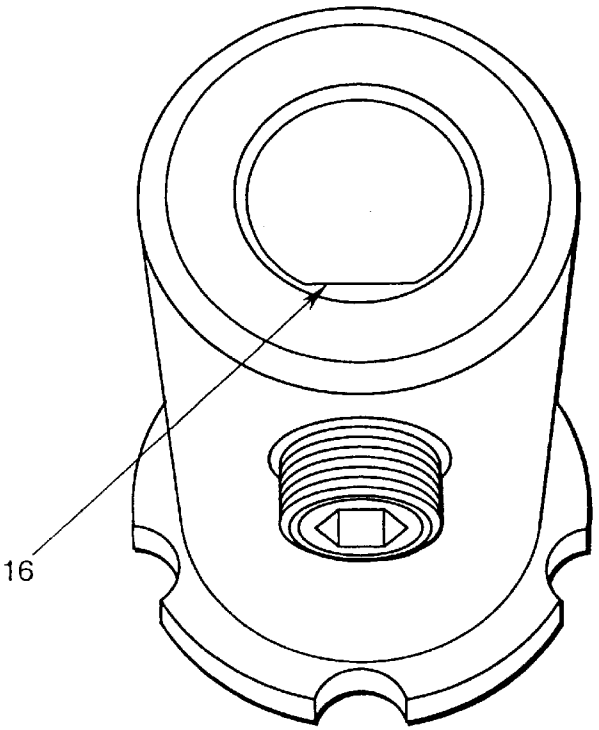
Fig. 12A (Prior Art)

As shown in FIGS. 11A and 12A, a prior art hub includes a generally cylindrical cavity with a relatively flattened portion 16, which is adapted to correspond with the flattened section of the shaft periphery so that the hub will not slip when the shaft is rotated. In order to form the prior art hub, a probe having a configuration generally similar to the shaft is inserted into a mold, and powdered metal within the mold is hardened. However, in order to remove the probe from the surrounding hub, the probe must have a tapered interior diameter, or else the probe will stick within the hub. Such a tapered inner diameter causes the tolerance between the cavity wall of the prior art hub and the shaft to increase along the shaft length, which as mentioned above, induces wobble and vibration in the inducer wheel. It will also be appreciated that the drive gear of the prior art hub shown in FIGS. 10A, 11A and 12A includes a generally circular periphery, with a series of five equal angularly spaced arcuate depressions. The prior art hub is placed in a mold for forming the rotor, liquid plastic is placed within the mold such that the plastic completely surrounds the drive gear of the prior art hub, and the plastic is then hardened such that the hub is captively joined to the rotor and such that the rotor rotates concurrently with the hub. As previously mentioned, the amount of plastic surrounding the drive gear of the prior art hub is relatively insufficient, especially when the hub wobbles or vibrates during rotation, whereby the rotor in the vicinity of the drive gear cracks and eventually breaks away completely.

The hub 14 of the present invention was designed to overcome the disadvantages associated with the prior art hub just described.

As shown in FIGS. 4–9, the hub 14 in a preferred embodiment of the present invention comprises a generally elongate body preferably fashioned of a unitary piece of metal, such as an hexagonal rod. As also will be appreciated from the following discussion, the hub 14 of a preferred embodiment of the present invention may be formed by machining, rather than by molding, that is, metal stock may be bored or ground in such a way as to fashion the hub 14.

Figure 6:
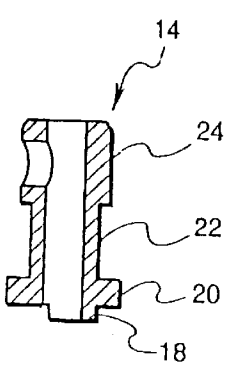
FIG. 6 is a cross sectional view of the hub shown in FIGS. 4 and 5, taken along the line 6—6 in FIG. 5.
Figure 7:
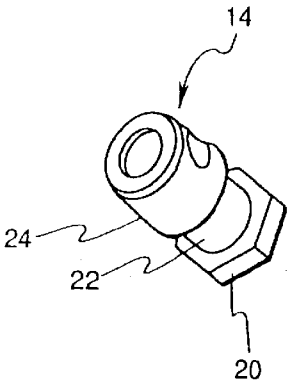
FIG. 7 is a perspective view of the hub shown in FIGS. 4–6.
Figure 8:
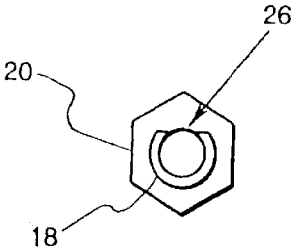
FIG. 8 is an end view of the hub shown in FIGS. 4–7.
Figure 9:
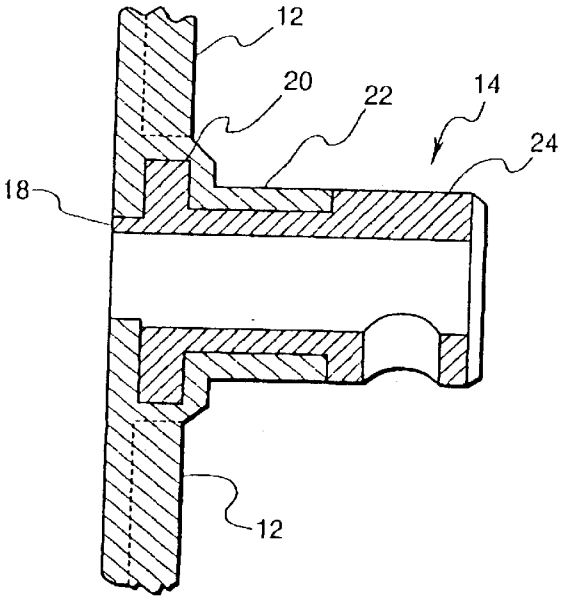
FIG. 9 is a cross sectional illustration of the hub shown in FIGS. 4–8 mounted and molded within the inducer wheel shown in FIGS. 1–3.

The hub 14 includes a central cylindrical cavity extending longitudinally therethrough, as best shown in FIGS. 6, 8, and 9. The hub 14 includes a partially cylindrical, cusped lip 18 disposed about one longitudinal end, a drive gear 20 disposed longitudinally inwardly of and adjacent to the lip 18, an annular recessed depression 22 disposed longitudinally inwardly of and adjacent to the drive gear 20, and a generally cylindrical flange 24 disposed adjacent to the annular depression 22 and adjacent to the other longitudinal end of the hub 14.

Figure 4:
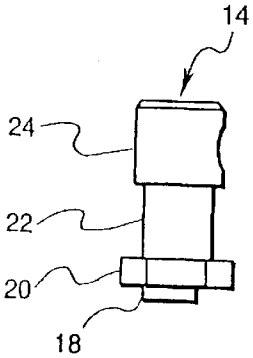
FIG. 4 is a side view of a hub that may be used in the inducer wheel shown in FIGS. 1–3.
Figure 5:
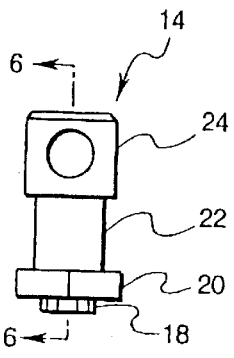
FIG. 5 is a top view of the hub shown in FIG. 4.

As illustrated in FIG. 4, the longitudinal length of the lip 18 is preferably 0.098 inches, the longitudinal length of the drive gear 20 is 0.158 inches, the longitudinal length of the depression 22 is 0.50 inches, and the overall longitudinal length of the hub 14 is 1.276 inches.

As shown in FIGS. 4–9, 10B, 11B, and 12B, the flange 24 possesses a threaded hole radially extending therethrough such that a set screw (not shown) may extend through the threaded hole to clamp the hub 14 against the rotatable shaft at a selected location therealong. Preferably, the threaded hole in the flange 24 is radially positioned such that the set screw, when tightened, forcibly abuts the flattened section of the shaft, which provides forceful clamping of the hub 14 to the rotatable shaft, which helps maintain the position of the hub 14 along the longitudinal length of the shaft as well as radially about the shaft.

As best shown in FIG. 8, the lip 18 is preferably cusped with an open section radially extending through a range of about 30 degrees to 120 degrees and more preferably about 60 degrees to 90 degrees about the longitudinal axis of the cavity and the hub 14. The open section may be formed by grinding a portion of the lip 18. It should be appreciated that the peripheral configuration of the lip 18 may be other than circular.

As best shown in FIG. 8, the internal diameter of the cavity is preferably 0.3121 inches, and the depth of the chord extending across the ends of the cusped lip 18 from the inner wall of the cavity is about 0.023 inches.

As best shown in FIGS. 7, 8, 10B, 11B, and 12B, the drive gear 20 very preferably possesses a hexagonal peripheral configuration, which may be formed by selecting hexagonal metal stock from which to form the hub 14 by machining. It should be understood that the peripheral surface of the drive gear may be other than circular, may be discontinuous, may be angular, may be a regular polygon, may be hexagonal, may be toothed, or may possess a variety of other configurations. Preferably, the forceful rotational contact of the drive gear periphery with the adjacent plastic of the rotor 12 will not cause the plastic to crack, chip, or deform in the area of contact with the drive gear 20.

As best shown in FIGS. 4–7, 9, 10B, and 12B, the annular depression 22 preferably possesses a peripheral cylindrical configuration, although other configurations are also contemplated within the scope of the present invention. Likewise, the flange 24 is preferably cylindrical, as best shown in FIGS. 4–7, 9, 10B, 12B, although other peripheral configurations are also contemplated within the scope of the present invention.

An inducer wheel 10 in accordance with a preferred embodiment of the present invention may be made by providing a mold for forming the rotor 12 from a liquid plastic. The hub 14 is then positioned within the mold such that the lip 18, the drive gear 20, and the depression 22 are disposed within the mold such that the liquid plastic flows around and intimately contacts the peripheral surface of the lip 18, the drive gear 20 and the depression 22. An object, such as an object having a flat surface corresponding to the flat surface of the rotatable shaft, is placed within the cavity of the hub 14 such that the flat surface extends across the open section of the lip 18 somewhat like the chord of a circle. The liquid plastic also intimately contacts the flat surface of the object, so that when the plastic hardens, the rotor 12 in the vicinity of the open portion of the lip 18 will possess a flat surface that is adapted to intimately contact and abut the flat surface of the rotatable shaft when the rotatable shaft extends into the cavity of hub 14. The flattened surface of the rotor 12 in the vicinity of the lip 18 abuttingly contacts the flattened portion of the rotatable shaft for positive placement of the inducer wheel 10 on the rotor 12. Transmission of rotational force is caused by the abutting contact of the set screw extending through the flange 24 in forceful engagement with the periphery of the shaft.

It will be appreciated that by having the plastic forming a portion of the rotor 12 cured within the annular depression 22, the hub 14 is more securely captively joined to the rotor 12, which will help minimize the effects of any wobbling, vibration, or any other non-radial forces upon the rotor 12.

While the invention has been described in conjunction with the preferred embodiment, it is evident that numerous alternatives, variations, and modifications will be apparent to those skilled in the art in light of the foregoing description. Thus, it is understood that the invention is not to be limited by the foregoing illustrative details.

We claim:

1. An inducer wheel for creating a fluid flow, said inducer wheel adapted to be mounted on a rotatable shaft for concurrent rotation with said shaft, said shaft possessing a substantially planar peripheral surface region, said inducer wheel comprising a rotor possessing a plurality of blades and a hub centrally disposed within said rotor, said rotor formed substantially entirely of a first material in the region of said rotor adjacent to said hub, and said hub formed substantially entirely of a second material different from said first material;

said hub comprising an elongate body having a first longitudinal end and a second longitudinal end and having a longitudinal axis extending between said longitudinal ends, said body possessing a cavity extending longitudinally through said body between each of said longitudinal ends along said longitudinal axis, said cavity adapted to receive said shaft therethrough such that said substantially planar, peripheral surface region is disposed substantially adjacent to said first longitudinal end of said body when said inducer wheel is mounted on said shaft for concurrent rotation therewith, said body possessing an open section radially extending from said cavity adjacent to said first longitudinal end of said body, said body possessing a drive gear disposed adjacent to said open section, the peripheral surface of said drive gear being non-circular;

said rotor substantially completely and intimately surrounding and filling said body open section such that said rotor is adapted to abuttingly contact said substantially planar peripheral surface region of said shaft when said inducer wheel is mounted on said shaft for concurrent rotation therewith, and said rotor substantially completely and intimately surrounding said body gear drive.

2. An inducer wheel according to claim 1 wherein said body possesses a substantially annular peripheral depression adjacent to said drive gear and wherein said rotor substantially completely and intimately surrounds and fills said peripheral depression.

3. An inducer wheel according to claim 1 wherein said hub further comprises means for clamping said body to said shaft at a selected location along said shaft.

4. An inducer wheel according to claim 1 wherein the peripheral surface of said drive gear is discontinuous.

5. An inducer wheel according to claim 4 wherein the peripheral surface of said drive gear is angular.

6. An inducer wheel according to claim 5 wherein the peripheral surface of said drive gear is a regular polygon.

7. An inducer wheel according to claim 6 wherein the peripheral surface of said drive gear is hexagonal.

8. An inducer wheel according to claim 1 wherein said first material is plastic and said second material is metal.

9. An inducer wheel according to claim 1 wherein said second material is metal and wherein said body is formed entirely by machining.

10. An inducer wheel according to claim 1 wherein said open section extends within the range of about 30 degrees to 120 degrees about said longitudinal axis in the region of said body defining said cavity.

11. An inducer wheel according to claim 10 wherein said open section extends within the range of about 60 degrees to 90 degrees about said longitudinal axis in the region of said body defining said cavity.

12. An inducer wheel according to claim 2 wherein said second material is metal and wherein said body is formed entirely by machining.

13. An inducer wheel according to claim 2 wherein said first material is plastic and said second material is metal.

14. An inducer wheel according to claim 2 wherein said open section extends within the range of about 30 degrees to 120 degrees about said longitudinal axis in the region of said body defining said cavity.

15. An inducer wheel according to claim 14 wherein said open section extends within the range of about 60 degrees to 90 degrees about said longitudinal axis in the region of said body defining said cavity.

16. An inducer wheel for creating a fluid flow, said inducer wheel adapted to be mounted on a rotatable shaft for concurrent rotation with said shaft, said shaft possessing a substantially planar peripheral surface region, said inducer wheel comprising a rotor possessing a plurality of blades and a hub centrally disposed within said rotor, said rotor formed substantially entirely of a first material in the region of said rotor adjacent to said hub, and said hub formed substantially entirely of a second material different from said first material in the region of said rotor adjacent to said hub;

said hub comprising an elongate body having a first longitudinal end and a second longitudinal end and having a longitudinal axis extending between said longitudinal ends, said body possessing a cylindrical cavity extending longitudinally through said body between each of said longitudinal ends coextensive along said longitudinal axis, said cavity adapted to receive said shaft therethrough such that said substantially planar, peripheral surface region is disposed substantially adjacent to said first longitudinal end of said body when said inducer wheel is mounted on said shaft for concurrent rotation therewith, said body possessing a lip adjacent to said first longitudinal end, said lip having an open section radially extending from said cavity, said body possessing a drive gear disposed adjacent to said lip, the peripheral surface of said drive gear being non-circular, said body possessing a substantially annular peripheral depression adjacent to said drive gear, and said body possessing a flange adjacent to said depression and adjacent to said second longitudinal end of said body, said hub further comprising means for clamping said body to said shaft at a selected location along said shaft;

said rotor substantially completely and intimately surrounding and filling said body lip open section such that said rotor is adapted to abuttingly contact said substantially planar peripheral surface region of said shaft when said inducer wheel is mounted on said shaft for concurrent rotation therewith, said rotor substantially completely and intimately surrounding said body gear drive, and said rotor substantially completely and intimately surrounding and filling said peripheral depression.

17. An inducer wheel according to claim 16 wherein the peripheral surface of said drive gear is discontinuous.

18. An inducer wheel according to claim 17 wherein the peripheral surface of said drive gear is angular.

19. An inducer wheel according to claim 18 wherein the peripheral surface of said drive gear is a regular polygon.

20. An inducer wheel according to claim 19 wherein the peripheral surface of said drive gear is hexagonal.

21. An inducer wheel according to claim 16 wherein said second material is metal and wherein said body is formed entirely by machining.

22. An inducer wheel according to claim 16 wherein said first material is plastic and said second material is metal.

23. An inducer wheel according to claim 16 wherein said open section extends within the range of about 30 degrees to 120 degrees about said longitudinal axis in the region of said body defining said cavity.

24. An inducer wheel according to claim 23 wherein said open section extends within the range of about 60 degrees to 90 degrees about said longitudinal axis in the region of said body defining said cavity.

25. An inducer wheel for creating a fluid flow, said inducer wheel adapted to be mounted on a rotatable shaft for concurrent rotation with said shaft, said shaft possessing a substantially planar peripheral surface region, said inducer wheel consisting essentially of a rotor possessing a plurality of blades and a hub centrally disposed within said rotor, said rotor formed substantially entirely of plastic in the region of said rotor adjacent to said hub, and said hub formed substantially entirely of metal, said hub consisting essentially of an elongate body and means for clamping said body to said shaft at a selected location along said shaft, said body having a first longitudinal end and a second longitudinal end and having a longitudinal axis extending between said longitudinal ends, said body possessing a cylindrical cavity extending longitudinally through said body between each of said longitudinal ends coextensive along said longitudinal axis, said cavity adapted to receive said shaft therethrough such that said substantially planar, peripheral surface region is disposed substantially adjacent to said first longitudinal end of said body when said inducer wheel is mounted on said shaft for concurrent rotation therewith, said body possessing a lip adjacent to said first longitudinal end, said lip having an open section radially extending from said cavity, said body possessing a drive gear disposed adjacent to said lip, the peripheral surface of said drive gear being non-circular, said body possessing a substantially annular peripheral depression adjacent to said drive gear, and said body possessing a flange adjacent to said depression and adjacent to said second longitudinal end of said body;

said rotor substantially completely and intimately surrounding and filling said body lip open section such that said rotor is adapted to abuttingly contact said substantially planar peripheral surface region of said shaft when said inducer wheel is mounted on said shaft for concurrent rotation therewith, said rotor substantially completely and intimately surrounding said body gear drive, and said rotor substantially completely and intimately surrounding and filling said peripheral depression.

26. An inducer wheel according to claim 25 wherein the peripheral surface of said drive gear is discontinuous.

27. An inducer wheel according to claim 26 wherein the peripheral surface of said drive gear is angular.

28. An inducer wheel according to claim 27 wherein the peripheral surface of said drive gear is a regular polygon.

29. An inducer wheel according to claim 28 wherein the peripheral surface of said drive gear is hexagonal.

30. An inducer wheel according to claim 25 wherein said body is formed entirely by machining.

31. An inducer wheel according to claim 25 wherein said first material is plastic and said second material is metal.

32. An inducer wheel according to claim 25 wherein said open section extends within the range of about 30 degrees to 120 degrees about said longitudinal axis in the region of said body defining said cavity.

33. An inducer wheel according to claim 32 wherein said open section extends within the range of about 60 degrees to 90 degrees about said longitudinal axis in the region of said body defining said cavity.

34. A method of making an impeller adapted to be mounted on a rotatable shaft and adapted for concurrent rotation with said shaft, said impeller consisting essentially of a rotor and a hub centrally disposed within said rotor, said method comprising providing a mold for forming said rotor from a liquid plastic;

providing a hub comprising an elongate body fashioned substantially entirely of metal, said body having a first longitudinal end and a second longitudinal end and having a longitudinal axis extending between said longitudinal ends, said body possessing a cylindrical cavity extending longitudinally through said body between each of said longitudinal ends coextensive with said longitudinal axis, said cavity adapted to receive said shaft therethrough, said body possessing a lip adjacent to said first longitudinal end, said lip having an open section radially extending from said cavity, said body having a drive gear disposed adjacent to said lip, said body possessing a substantially annular peripheral depression adjacent to said drive gear, and said body possessing a flange adjacent to said depression and adjacent to said second longitudinal end of said body;

positioning said hub such that said lip, said drive gear, and said depression are within said mold;

placing an object having a substantially planar surface within said cavity adjacent to said lip such that said substantially planar surface extends substantially across said cylindrical cavity substantially as a chord extending substantially across said open section of said lip;

depositing liquid plastic in said mold such that said liquid plastic substantially completely and intimately surrounds said lip and substantially fills said lip open section and intimately contacts said substantially planar surface of said object, substantially completely and intimately surrounds said drive gear, and substantially completely and intimately surrounds and fills said peripheral depression; and curing said liquid plastic into a hardened state whereby said hub is captively joined to said hardened plastic.

35. A method of making an impeller according to claim 34 further comprising:

removing said object from within said cavity.

36. A method of making an impeller according to claim 34 wherein said body is formed entirely by machining.

37. An inducer wheel according to claim 34 wherein said open section extends within the range of about 30 degrees to 120 degrees about said longitudinal axis in the region of said body defining said cavity.

38. An inducer wheel according to claim 37 wherein said open section extends within the range of about 60 degrees to 90 degrees about said longitudinal axis in the region of said body defining said cavity.

39. An impeller adapted to be mounted on a rotatable shaft and adapted for concurrent rotation with said shaft, said impeller consisting essentially of a rotor and a hub centrally disposed within said rotor, said impeller made by a method comprising providing a mold for forming said rotor from a liquid plastic;

providing a hub comprising an elongate body fashioned substantially entirely of metal, said body having a first longitudinal end and a second longitudinal end and having a longitudinal axis extending between said longitudinal ends, said body possessing a cylindrical cavity extending longitudinally through said body between each of said longitudinal ends coextensive with said longitudinal axis, said cavity adapted to receive said shaft therethrough, said body possessing a lip adjacent to said first longitudinal end, said lip having an open section radially extending from said cavity, said body having a drive gear disposed adjacent to said lip, said body possessing a substantially annular peripheral depression adjacent to said drive gear, and said body possessing a flange adjacent to said depression and adjacent to said second longitudinal end of said body;

positioning said hub such that said lip, said drive gear, and said depression are within said mold;

placing an object having a substantially planar surface within said cavity adjacent to said lip such that said substantially planar surface extends substantially across said cylindrical cavity substantially as a chord extending substantially across said open section of said lip;

depositing liquid plastic in said mold such that said liquid plastic substantially completely and intimately surrounds said lip and substantially fills said lip open section and intimately contacts said substantially planar surface of said object, substantially completely and intimately surrounds said drive gear, and substantially completely and intimately surrounds and fills said peripheral depression; and curing said liquid plastic into a hardened state whereby said hub is captively joined to said hardened plastic.

40. A method of making an impeller according to claim 39 wherein said body is formed entirely by machining.

41. An inducer wheel according to claim 39 wherein said open section extends within the range of about 30 degrees to 120 degrees about said longitudinal axis in the region of said body defining said cavity.

42. An inducer wheel according to claim 41 wherein said open section extends within the range of about 60 degrees to 90 degrees about said longitudinal axis in the region of said body defining said cavity.

* * * * *